US009406991B2

(12) United States Patent
Bao

(10) Patent No.: US 9,406,991 B2
(45) Date of Patent: Aug. 2, 2016

(54) QUADRATURE HYBRID

(75) Inventor: Mingquan Bao, Vastra Frolunda (SE)

(73) Assignee: TELEFONAKTIEBOLAGET LM ERICSSON (publ), Stockholm (SE)

( * ) Notice: Subject to any disclaimer, the term of this patent is extended or adjusted under 35 U.S.C. 154(b) by 9 days.

(21) Appl. No.: 14/416,703

(22) PCT Filed: Jul. 27, 2012

(86) PCT No.: PCT/EP2012/064758
§ 371 (c)(1),
(2), (4) Date: Jan. 23, 2015

(87) PCT Pub. No.: WO2014/015913
PCT Pub. Date: Jan. 30, 2014

(65) Prior Publication Data
US 2015/0200436 A1 Jul. 16, 2015

(51) Int. Cl.
*H01P 5/18* (2006.01)
*H01P 3/08* (2006.01)
*H01P 5/12* (2006.01)
*H01P 3/00* (2006.01)

(52) U.S. Cl.
CPC *H01P 5/12* (2013.01); *H01P 3/003* (2013.01); *H01P 3/081* (2013.01); *H01P 5/184* (2013.01)

(58) Field of Classification Search
CPC ..... H01P 5/18
USPC ..... 333/109, 110, 111, 112, 117, 246
See application file for complete search history.

(56) References Cited

U.S. PATENT DOCUMENTS

| | | | | |
|---|---|---|---|---|
| 4,375,054 | A | 2/1983 | Pavio | |
| 4,626,889 | A * | 12/1986 | Yamamoto | H01L 23/522 257/664 |
| 5,214,318 | A * | 5/1993 | Nakanishi | H03K 5/151 326/124 |
| 6,373,275 | B1 * | 4/2002 | Otsuka | G06F 13/4086 326/30 |
| 6,492,881 | B2 * | 12/2002 | Wright | H01P 5/10 333/25 |
| 6,670,830 | B2 * | 12/2003 | Otsuka | G06F 13/4072 326/30 |
| 8,195,990 | B2 * | 6/2012 | Ho | H04B 5/0075 257/503 |
| 9,270,002 | B2 * | 2/2016 | Kaper | G06F 13/4068 |
| 2004/0113716 | A1 | 6/2004 | Hilal et al. | |
| 2004/0119559 | A1 | 6/2004 | Shumovich | |

OTHER PUBLICATIONS

PCT International Search Report, mailed Apr. 25, 2013, in connection with International Application No. PCT/EP2012/064758, all pages.

(Continued)

*Primary Examiner* — Dean Takaoka
(74) *Attorney, Agent, or Firm* — Leffler Intellectual Property Law, PLLC

(57) ABSTRACT

A quadrature hybrid comprising first and second coupled open waveguides. Each open waveguide comprises first and second ports. One port in the first open waveguide is used as input port for an input signal which is used to generate I and Q output signals. The other port in the first open waveguide is used to output the Q signal, and one of the ports in the second waveguide is used to output the I signal. The other of the ports in the second open waveguide is an isolated port. The quadrature hybrid comprises a first differential amplifier with positive and negative ports, the positive port being connected to the first open waveguide and the negative port being connected to the second open waveguide.

10 Claims, 9 Drawing Sheets

(56) References Cited

OTHER PUBLICATIONS

PCT Written Opinion, mailed Apr. 25, 2013, in connection with International Application No. PCT/EP2012/064758, all pages.

Stuckert, Paul E. "Active DC directional couplers" IEEE Transactions on Instrumentation and Measurement, IEEE Service Center, Piscataway, NJ, US, vol. IM-25, No. 3, Sep. 1, 1976, pp. 241-244, XP011464319, ISSN: 0018-9456, DOI: 10.1109/TIM.1976.6312355.

* cited by examiner

Q, embodiment 500

I, embodiment 500

QUADRATURE HYBRID

TECHNICAL FIELD

The present invention discloses an improved quadrature hybrid with improved bandwidth and reduced size.

BACKGROUND

A quadrature hybrid is a component which has one input port and two output ports, and which is arranged to use an input RF signal at the input port to generate two output signals, one at each output port but with a ninety degree phase difference between them, so called I and Q signals. The amplitude of the I and Q signals will (in an ideal quadrature hybrid) be the same and will be half of the amplitude of the input signal, for which reason a quadrature hybrid is also sometimes referred to as a "3 dB quadrature hybrid".

Quadrature hybrids are widely used in microwave applications such as, for example, amplifiers and mixers, as well as in phase shifters and other such microwave applications. In broadband circuits, there is naturally a need for broadband quadrature hybrids.

One way of designing traditional quadrature hybrids is by means of so called "lumped components", e.g. inductors and capacitors. A drawback to such quadrature hybrids is that they have quite a narrow operational bandwidth as well as a rather low relative bandwidth.

Another traditional way of designing quadrature hybrids is to use microstrip lines. Such quadrature hybrids have a broad bandwidth and a good relative bandwidth, but are also of a large size.

Techniques to design quadrature hybrids by means of capacitors in microstrip based quadrature hybrids. So called metatransmission lines have also been utilized to obtain quadrature hybrids.

However, the relative bandwidth of the quadrature hybrids enumerated above remain limited, particularly since, in some broadband applications, a relative bandwidth of more than 100% is required, a performance which these known quadrature hybrids cannot provide.

SUMMARY

It is an object of the invention to provide a quadrature hybrid which obviates at least some of the disadvantages of known quadrature hybrids, in particular when it comes to size and bandwidth.

This object is achieved by means of a quadrature hybrid which comprises a first and a second open waveguide which are electrically coupled to each other. Each of the open waveguides comprises a first and a second port. One of the ports in the first open waveguide is arranged to be used as input port for an input signal which the quadrature hybrid is arranged to use to generate I and Q output signals, and the other port in the first open waveguide is arranged to be used to output the Q signal, and one of the ports in the second waveguide is arranged to be used to output the I signal. The other of the ports in the second open waveguide is arranged to be an isolated port, and the quadrature hybrid additionally comprises a first differential amplifier with a positive and a negative port. The positive port is connected to the first open waveguide and the negative port is connected to the second open waveguide.

In embodiments of the quadrature hybrid, the first differential amplifier has its connections to a point in the open waveguides which is at a centre point of the open waveguides.

In embodiments, the quadrature hybrid comprises a second differential amplifier with a positive and a negative port, where the positive port is connected to the first open waveguide and the negative port is connected to the second open waveguide.

In embodiments of the quadrature hybrid, the second differential amplifier has its connections to the open waveguides at a distance of L/2 from the connections of the first differential amplifier, where L is the lengths of the open waveguides.

In embodiments, the quadrature hybrid comprises a third differential amplifier with a positive and a negative port, with the positive port being connected to the first open waveguide and the negative port being connected to the second open waveguide.

In embodiments of the quadrature hybrid, the third differential amplifier has its connections to the open waveguides at a distance of L/4 from the connections of the first differential amplifier and at a distance of 3L/4 from the connections of the second differential amplifier.

BRIEF DESCRIPTION OF THE DRAWINGS

The invention will be described in more detail in the following, with reference to the appended drawings, in which.

DETAILED DESCRIPTION

Figure 1:
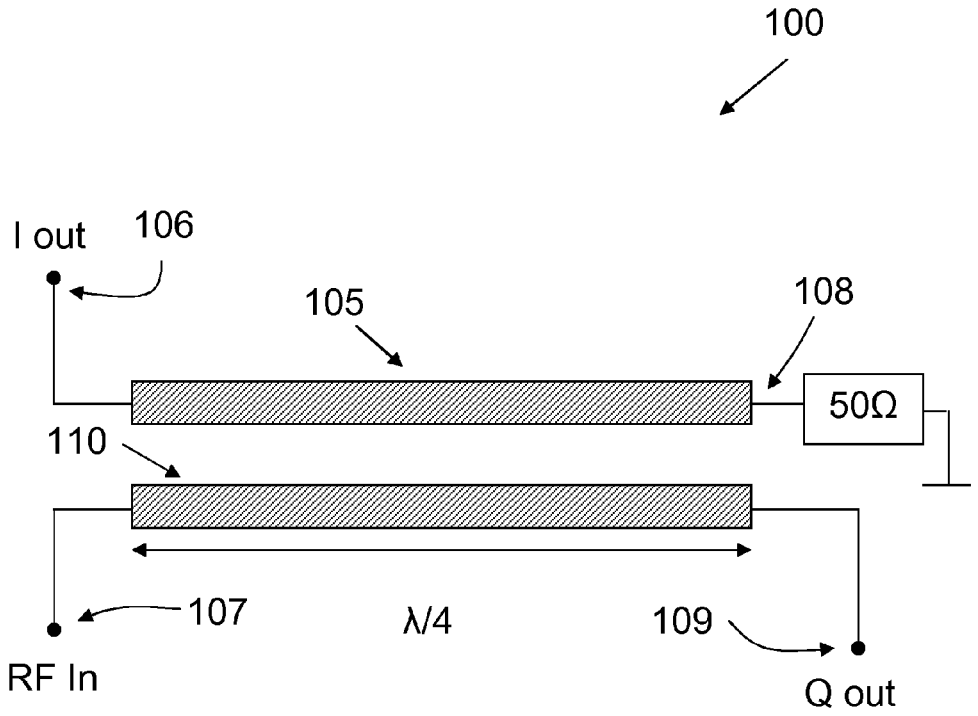
Prior Art Fig. 1
FIG. 1 shows a prior art quadrature hybrid.

Embodiments of the present invention will be described more fully hereinafter with reference to the accompanying drawings, in which embodiments of the invention are shown. The invention may, however, be embodied in many different forms and should not be construed as being limited to the embodiments set forth herein. Like numbers in the drawings refer to like elements throughout.

The terminology used herein is for the purpose of describing particular embodiments only, and is not intended to limit the invention.

FIG. 1 shows an example of a prior art quadrature hybrid 100. As shown in FIG. 1, the quadrature hybrid 100 comprises a first 110 and a second 105 open waveguide, which are electrically coupled to each other. The first open waveguide comprises a first 107 and a second 109 port, and the second open waveguide also comprises a first 106 and a second 108 port. The waveguides should be of equal length, which should be a quarter of the desired operational centre wavelength of the quadrature hybrid, shown as $\lambda/4$ in FIG. 1.

As shown in FIG. 1, the port 107 in the open waveguide 110 is arranged to be used as input port for an RF (Radio Frequency) signal. The other port 109 in the open waveguide 110 is arranged to output a so called Quadrature Phase signal, commonly referred to as a Q signal, and the port 106 in the open waveguide 105 is arranged to output a so called In Phase signal, commonly referred to as an I signal. The I and Q signals are generated from the RF signal, and have, in an ideal circuit, the same amplitude but a phase difference of ninety degrees. The I and Q signals ideally have the same amplitude, which ideally will be half the amplitude of the input RF signal.

In addition, the port 108 in the open waveguide 105 is arranged to be a so called "isolated port", usually connected to ground via a 500 resistor, which in an ideal case causes no RF energy to be lost from the circuit 100 via the isolated port 108.

Thus, in the quadrature hybrid 100 of FIG. 1, we have an input RF signal at port 107 and at ports 106 and 109 we obtain I and Q output signals.

Figure 2:
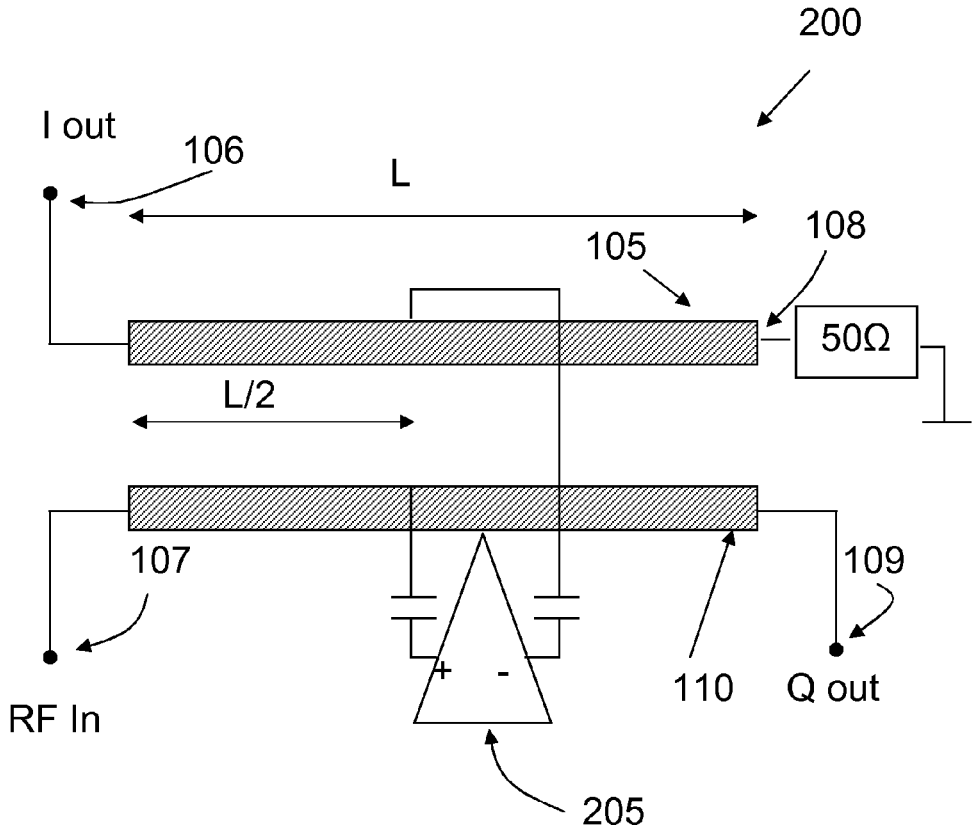
FIG. 2 shows a first embodiment of a quadrature hybrid.

FIG. 2 shows a first embodiment of a quadrature hybrid 200 of the invention. In addition to the features of the quadrature hybrid 100 of FIG. 1, the quadrature hybrid 200 comprises a differential amplifier 205, which has a positive and a negative port, marked with plus and minus signs in FIG. 2, and, as shown in FIG. 2, the positive port is connected to the open waveguide 110 and the negative port is connected to the open waveguide 105. The connections could also be the opposite, i.e. it does not matter which of the ports of the amplifier 205 that is connected to which of the open waveguides. Suitably, the distances between the connection points for the negative and the positive ports of the differential amplifier 205 and the ends of the two open waveguides are the same, and are preferably L/2, where L is the total length of the open waveguides. In other words, preferably, the positive and negative ports of the amplifier 205 are both connected to the middle of their respective open waveguide.

Regarding the open waveguides, they can be designed according to a number of different techniques for open waveguides, for example the following:

microstrip lines
strip lines
coplanar waveguide, and will be arranged to be coupled to each other by means of having a common ground plane, as well as by means of electromagnetic interaction between the two waveguides. It should be pointed out that one of the open waveguide can be designed in one of the techniques listed above and the other open waveguide can be designed from one of the other techniques, although usually, both of the open waveguides will be designed in the same technique.

Figure 3:
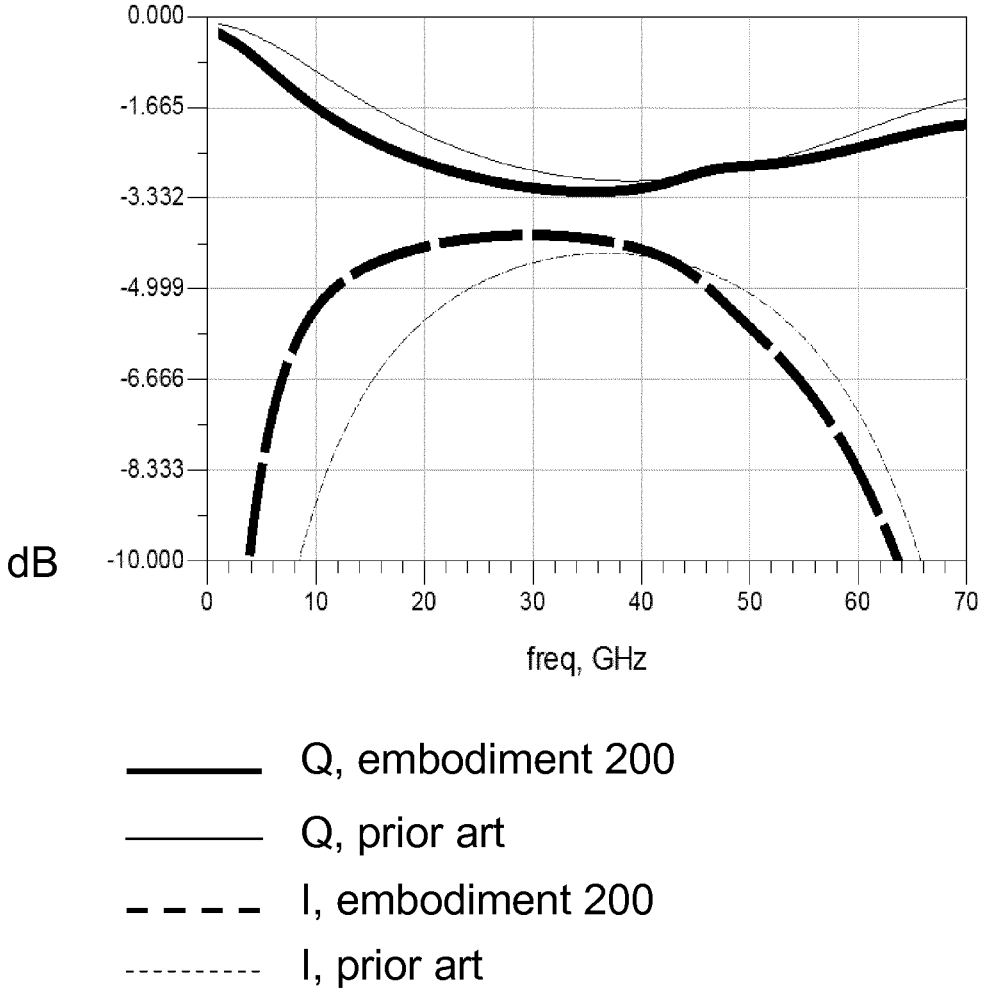
FIG. 3 shows a performance graph of the embodiment of FIG. 2.

FIG. 3 shows graphs which illustrate and advantage gained by means of the quadrature hybrid 200 of FIG. 2 as compared to the prior art quadrature hybrid 100 of FIG. 1: we see that the amplitude of the I signal is improved, particularly in the frequency range of 10 GHz to 40 GHz. At frequencies above 40 GHz, the amplitude of the I signal decreases, but this is due to the fact that the quadrature hybrid for which the graph was generated is optimized for frequencies below 40 GHz by means of the length of the coupled open waveguides. If it is desired to obtain higher amplitudes at frequencies above 40 GHz, the length of the coupled open waveguides could be shortened accordingly, i.e. given a length which corresponds to $\lambda/4$, where $\lambda$ is the operational (centre) frequency of the quadrature hybrid.

Figure 4:
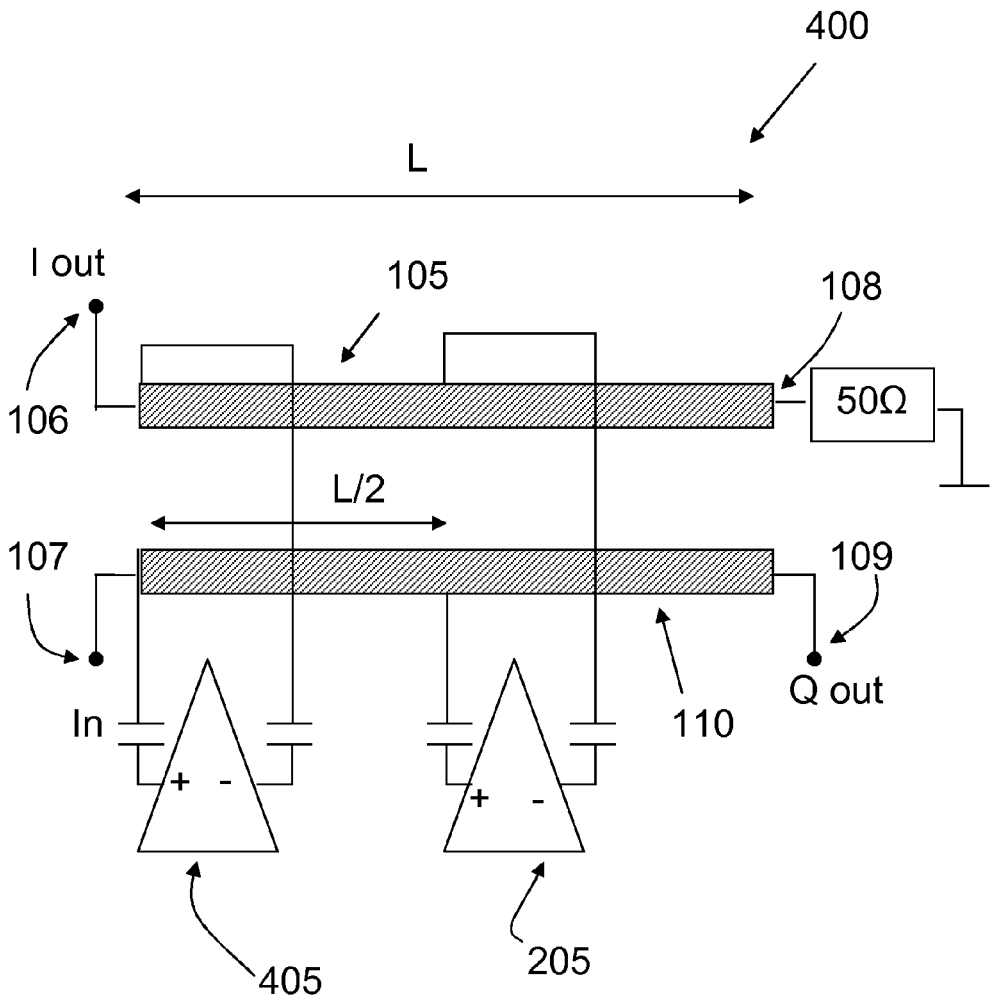
FIG. 4 shows a second embodiment of a quadrature hybrid.

However, as can also be seen in the graphs of FIG. 3, the amplitude of the Q signal is not boosted in the same manner as that of the I signal. If it is desired to remedy this, the quadrature hybrid can be equipped with an additional differential amplifier 405, as shown in FIG. 4, by means of which a quadrature hybrid 400 is obtained. In this case, as shown in FIG. 4, the additional, second differential amplifier 405 should have its connections to the open waveguides at a distance from the connections of the first differential amplifier 205 which equals L/2, i.e. the second differential amplifier is connected to one end of the open waveguides, while the first differential amplifier 205 is connected to the centre of the open waveguides.

Figure 5:
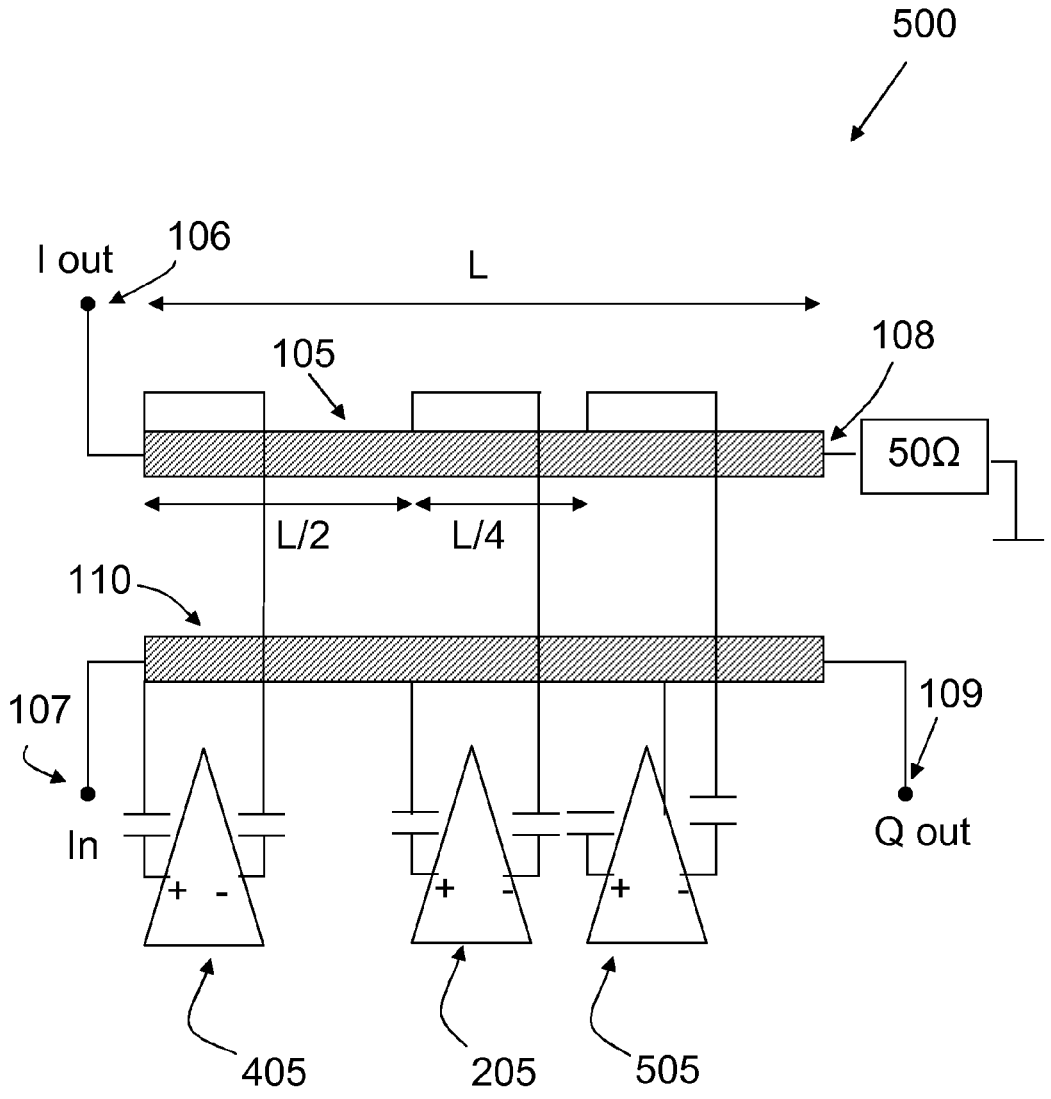
FIG. 5 shows a third embodiment of a quadrature hybrid.

In a further embodiment, the quadrature hybrid is also equipped with a third differential amplifier 505, by means of which a quadrature hybrid 500 is obtained, as shown in FIG. 5. As indicated in FIG. 5, the position for the first 205 and second differential amplifiers 405 are maintained as described above, while the third differential amplifier 505, is connected with both of its ports to a point of the open waveguides 105, 110, which is L/4 from the connections of the first differential amplifier 205, and this 3L/4 from the connections of the second differential amplifier 405.

Figure 6:
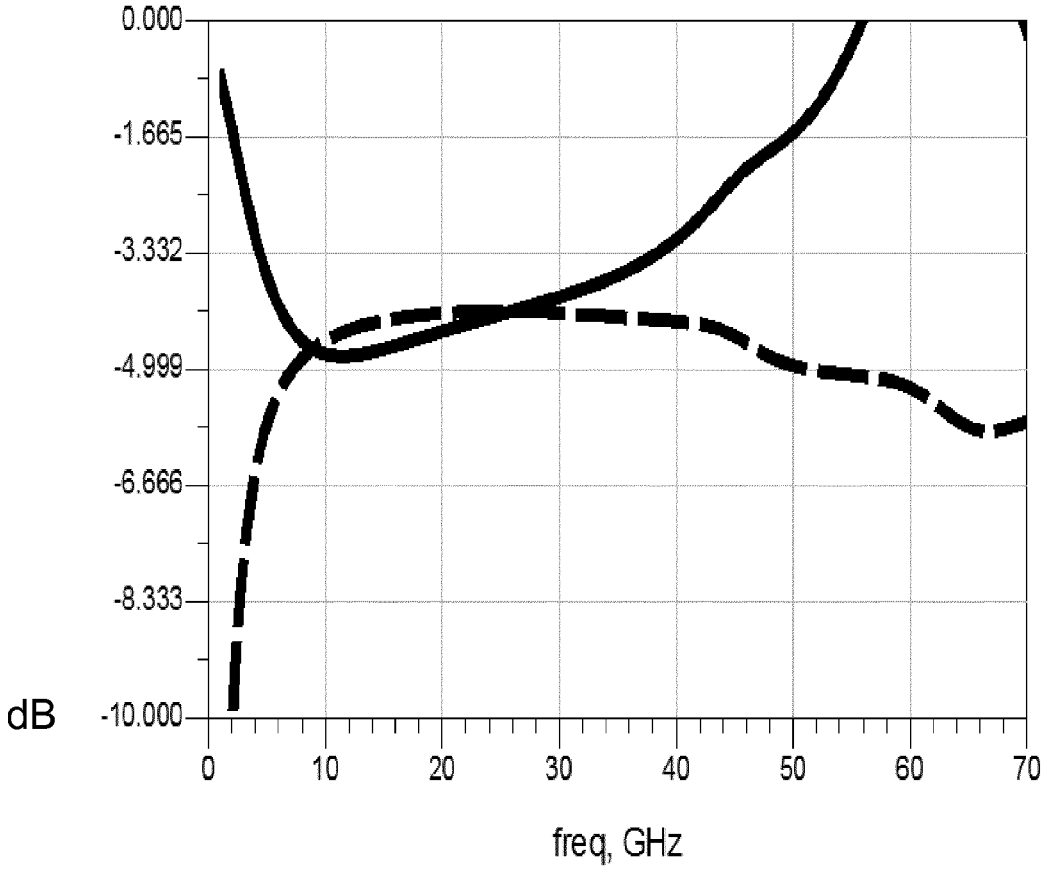
FIGS. 6-8 show performance graphs of the embodiment of FIG. 5.

FIG. 6 shows a graph of the amplitudes of the I and Q signals of the embodiment 500 as a function of frequency: we see that the amplitude of the Q signal approaches that of the I signal, and that the amplitude of the I signal has increased slightly from the embodiment 200 in FIG. 2. This means that more power is transferred from the Q port to the I port by means of the three differential amplifiers 205, 405 and 505. As a consequence of this, balanced output amplitudes is achieved in a frequency range of 6.3 to 39 GHz.

Figure 7:
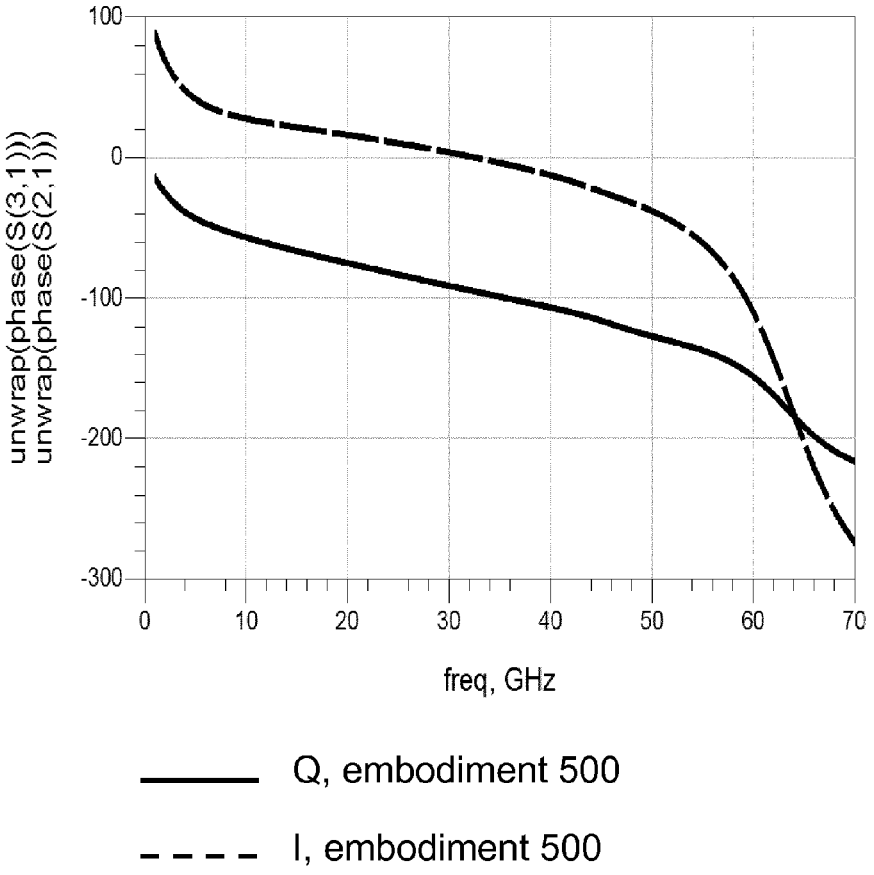

FIG. 7 shows the phase of the I and Q signals: we see that the phase difference of 90 degrees is essentially maintained in the interval of 6.3 to 39 GHz.

Figure 8:
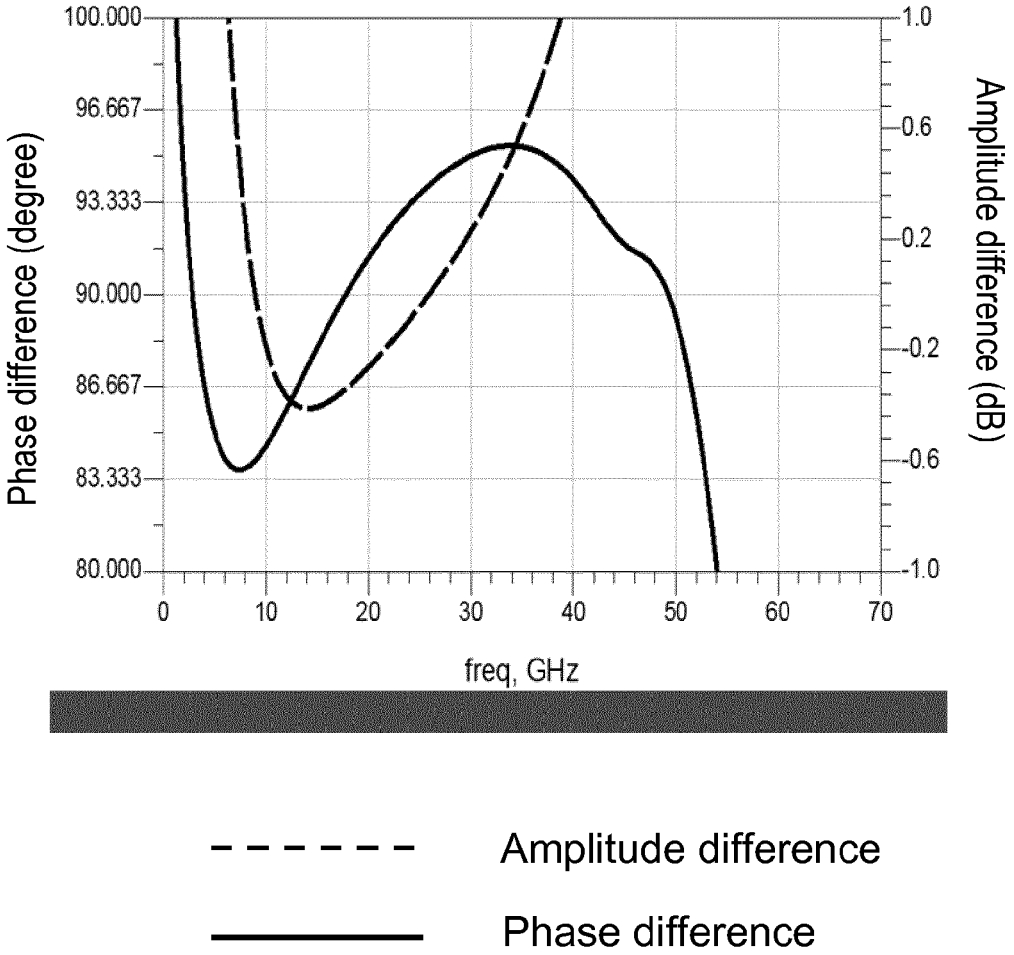
Figure 9:
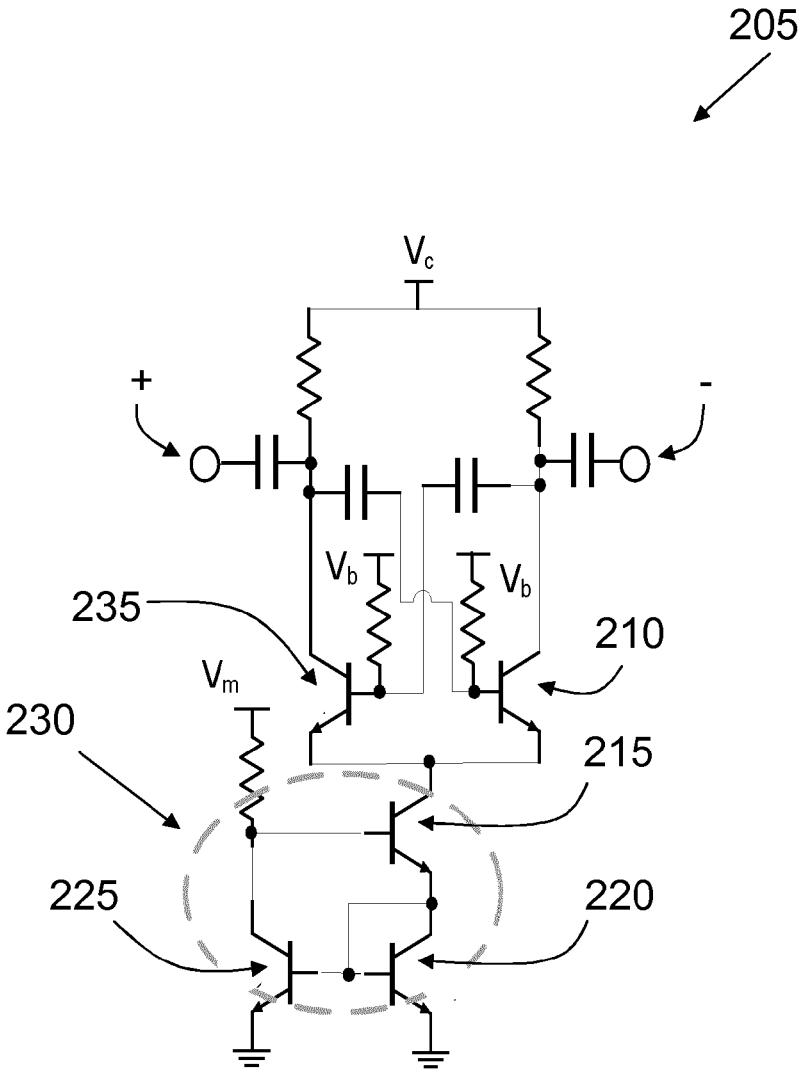
FIG. 9 shows an embodiment of a differential amplifier.

FIG. 8 shows both the phase difference between the I and Q signals (solid line) and the amplitude difference between the I and Q signals (dashed line). A conclusion that can be drawn from the graph of FIG. 9 is that acceptably balanced output amplitudes are achieved within the frequency range of 6.3 to 39 GHz, with the amplitude difference between the I and Q ports being less than 1 dB. In addition, the maximum phase error is no more than 7 degrees, which is almost equal to that of other designs.

FIG. 9 shows an embodiment of a differential amplifier such as the one 205 which has been used in the embodiments of FIGS. 2, 4 and 5. In FIG. 9, we see the positive and negative ports, shown by means of a plus and a minus sign. Actually, the ports can be used in either combination, i.e. if one port is used as the negative port, the other port will serve as the positive port.

The differential amplifier 205 comprises bipolar transistors, but can also be designed using FET transistors, in which case the following substitutions should be made in the text below:

| Bipolar | FET |
|---|---|
| Base | Gate |
| Collector | Drain |
| Emitter | Source |

Each of the ports is connected to the collector of a respective transistor 235, 210 via respective first capacitors. The emitters of the first 210 and second 235 transistors are connected to each other, and are connected to a current source 230 which is comprised in the differential amplifier 205. The base of each of the transistors 210, 235 is "cross-connected" to the collector of the other transistor 235, 210 via respective second capacitors.

As mentioned, the transistors 210, 235 have their emitters connected to each other, and are via this connection connected to a current source 230 comprised in the differential amplifier 205. The current source 230 comprises a third 220 and a fourth 225 transistor, which have their bases connected to each other and have their emitters connected to ground. The base of the third transistor 220 is connected to the transistor's collector, which is also connected to the emitter of a fifth transistor 215, which is also comprised in the current source 230. In addition, the collector of the fourth transistor 225, is connected to the base of the fifth transistor 215. The collector of the fifth transistor 215 serves as the "connection point" between the current source 230 and the rest of the differential amplifier 205.

As can be seen in FIG. 9, the differential amplifier 900 is arranged to have a number of voltages applied to it. Using the notations of FIG. 9, these are as follows:

Vb: DC bias voltage applied at the base of the first 210 and the second 235 transistor, Vm: DC bias voltage for the current source 230, applied at the collector of the transistor 225 and the base of the transistor 215, Vc: DC supply voltage at the collectors of the transistors 210 and 235, suitably via equally sized resistors.

In the drawings and specification, there have been disclosed exemplary embodiments of the invention. However, many variations and modifications can be made to these embodiments without substantially departing from the principles of the present invention. Accordingly, although specific terms are employed, they are used in a generic and descriptive sense only and not for purposes of limitation.

The invention is not limited to the examples of embodiments described above and shown in the drawings, but may be freely varied within the scope of the appended claims.

The invention claimed is:

1. A quadrature hybrid comprising a first open waveguide and a second open waveguide which are electrically coupled to each other, with each of said first and second open waveguides comprising a first and a second port, where one of the ports in the first open waveguide is arranged to be used as an input port for an input signal which the quadrature hybrid is arranged to be used to generate I and Q output signals, with the other port in the first open waveguide being arranged to be used to output said Q signal, and one of the ports in the second open waveguide is arranged to be used to output said I signal with the other of the ports in the second open waveguide being arranged to be an isolated port, the quadrature hybrid additionally comprising a first differential amplifier with a positive and a negative port, with the positive port being connected to the first open waveguide and the negative port being connected to the second open waveguide.

2. The quadrature hybrid of claim 1, in which the first differential amplifier has its connections to a point in the first and second open waveguides which is at a centre point of the open waveguides.

3. The quadrature hybrid of claim 1, comprising a second differential amplifier with a positive and a negative port, with the positive port being connected to the first open waveguide and the negative port being connected to the second open waveguide.

4. The quadrature hybrid of claim 3, in which the second differential amplifier has its connections to the first and second open waveguides at a distance of L/2 from the connections of the first differential amplifier, where L is the lengths of the open waveguides.

5. The quadrature hybrid of claim 1, comprising a third differential amplifier with a positive and a negative port, with the positive port being connected to the first open waveguide and the negative port being connected to the second open waveguide.

6. The quadrature hybrid of claim 5, in which the third differential amplifier has its connections to the first and second open waveguides at a distance of L/4 from the connections of the first differential amplifier and at a distance of 3L/4 from the connections of the second differential amplifier.

7. The quadrature hybrid of claim 1, in which the first and second open waveguides are microstrip lines with a common ground plane.

8. The quadrature hybrid of claim 1, in which the first and second open waveguides are strip line waveguides with a common ground plane.

9. The quadrature hybrid of any of claim 1, in which the first and second open waveguides are coplanar waveguides.

10. The quadrature hybrid of claim 1, in which each of the first and the second open waveguides is selected from a group consisting of the following kinds of open waveguides:

microstrip lines; strip lines; and coplanar waveguide, which are coupled to each other by means of having a common ground plane.

* * * * *